US008827076B2

(12) United States Patent
Kuo

(10) Patent No.: US 8,827,076 B2
(45) Date of Patent: Sep. 9, 2014

(54) MODULAR PANEL-PACKING BOX

(71) Applicant: San Ho Paper & Carton Co., Ltd., Bade (TW)

(72) Inventor: Kun-Chung Kuo, Bade (TW)

(73) Assignee: San Ho Paper & Carton Co., Ltd., Bade (TW)

( * ) Notice: Subject to any disclaimer, the term of this patent is extended or adjusted under 35 U.S.C. 154(b) by 49 days.

(21) Appl. No.: 13/649,557

(22) Filed: Oct. 11, 2012

(65) Prior Publication Data

US 2013/0270332 A1 Oct. 17, 2013

(30) Foreign Application Priority Data

Oct. 12, 2011 (TW) ..... 100136947 A

(51) Int. Cl.
*B65D 85/48* (2006.01)
*B65D 5/49* (2006.01)

(52) U.S. Cl.
CPC ..... *B65D 5/48024* (2013.01)
USPC ..... 206/454; 206/485; 206/587; 220/533

(58) Field of Classification Search
CPC .... B65D 5/5028; B65D 25/107; B65D 85/48; H01L 21/67369; H01L 21/67386
USPC ..... 206/425, 454, 485, 587–594; 211/41.14; 220/533
See application file for complete search history.

(56) References Cited

U.S. PATENT DOCUMENTS

| | | | | | |
|---|---|---|---|---|---|
| 4,427,114 | A * | 1/1984 | Howell et al. | ..... | 206/454 |
| 4,763,782 | A * | 8/1988 | Sinchok | ..... | 220/533 |
| 4,779,752 | A * | 10/1988 | Vallee et al. | ..... | 220/533 |
| 6,010,007 | A * | 1/2000 | Moren et al. | ..... | 206/587 |
| 6,142,304 | A * | 11/2000 | Moren et al. | ..... | 206/587 |
| 6,997,318 | B2 * | 2/2006 | Park | ..... | 206/454 |
| 7,225,925 | B2 * | 6/2007 | Chen et al. | ..... | 206/454 |
| 7,290,663 | B2 * | 11/2007 | Deng et al. | ..... | 206/454 |
| 7,374,044 | B2 * | 5/2008 | Ting | ..... | 206/454 |
| 7,578,390 | B2 * | 8/2009 | Ting | ..... | 206/454 |
| 7,604,121 | B1 * | 10/2009 | Tang et al. | ..... | 206/454 |
| 2001/0027934 | A1 * | 10/2001 | Yoneda et al. | ..... | 206/485 |

* cited by examiner

*Primary Examiner* — Bryon Gehman
(74) *Attorney, Agent, or Firm* — The Webb Law Firm

(57) ABSTRACT

A modular panel-packing box receives a plurality of panels, and includes a base, two partitioning units, a loop-shaped surrounding wall, and a top cover. Each of the partitioning units includes a socket and at least one partitioning member. Any two adjacent ones of the base, the socket, the partitioning member, the surrounding wall, and the top cover are interconnected removably. Each of the base, the socket, the partitioning member, and the top cover is folded, and is unfoldable to form a flat plate for facilitating transportation and storage of the modular panel-packing box.

9 Claims, 14 Drawing Sheets

MODULAR PANEL-PACKING BOX

CROSS-REFERENCE TO RELATED APPLICATION

This application claims priority of Taiwanese Application No. 100136947, filed on Oct. 12, 2011.

BACKGROUND OF THE INVENTION

1. Field of the Invention

This invention relates to a packing box, and more particularly to a modular panel-packing box.

2. Description of the Related Art

Solar panels or LCD panels are typically transported in such a manner that they are put into packing boxes. Each of the packing boxes includes a plurality of vertical partitioning plates made of paper. Any two adjacent ones of the partitioning plates define a space for receiving one of the panels. As such, friction among the panels and vibration of the panels occurring during transportation can be diminished.

However, when the packing boxes are idle, they occupy a large amount of space, thereby resulting in inconvenience during transportation of the packing boxes.

SUMMARY OF THE INVENTION

The object of this invention is to provide a modular panel-packing box that is convenient to transport.

Accordingly, the modular panel-packing box of this invention is adapted for receiving a plurality of upright panels. The modular panel-packing box includes a base, two partitioning units, a loop-shaped surrounding wall, and a top cover.

The base includes a bottom wall and a base surrounding wall extending upwardly from the bottom wall.

Each of the partitioning units includes a socket formed with a plurality of insert slots, and a partitioning member having a plurality of partitioning plates that are inserted respectively and fixedly into the insert slots and that define a plurality of spacer slots. The partitioning members of the partitioning units are disposed on the bottom wall of the base, and are spaced apart from each other, such that the spacer slots in one of the partitioning members are aligned respectively with those in the other of the partitioning members. The panels are disposed between the partitioning members, and extend respectively into the spacer slots in either of the partitioning members.

The loop-shaped surrounding wall is disposed on the base, and surrounds the partitioning units.

The top cover is connected to the surrounding wall for covering upper ends of the panels.

Each of the base, the sockets and the partitioning members of the partitioning units, and the top cover is in a folded state.

When the modular panel-packing box is idle and transported, each of the base, the sockets and the partitioning members of the partitioning units, and the top cover can be unfolded to form a flat plate for reducing the space occupied by the modular panel-packing box.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
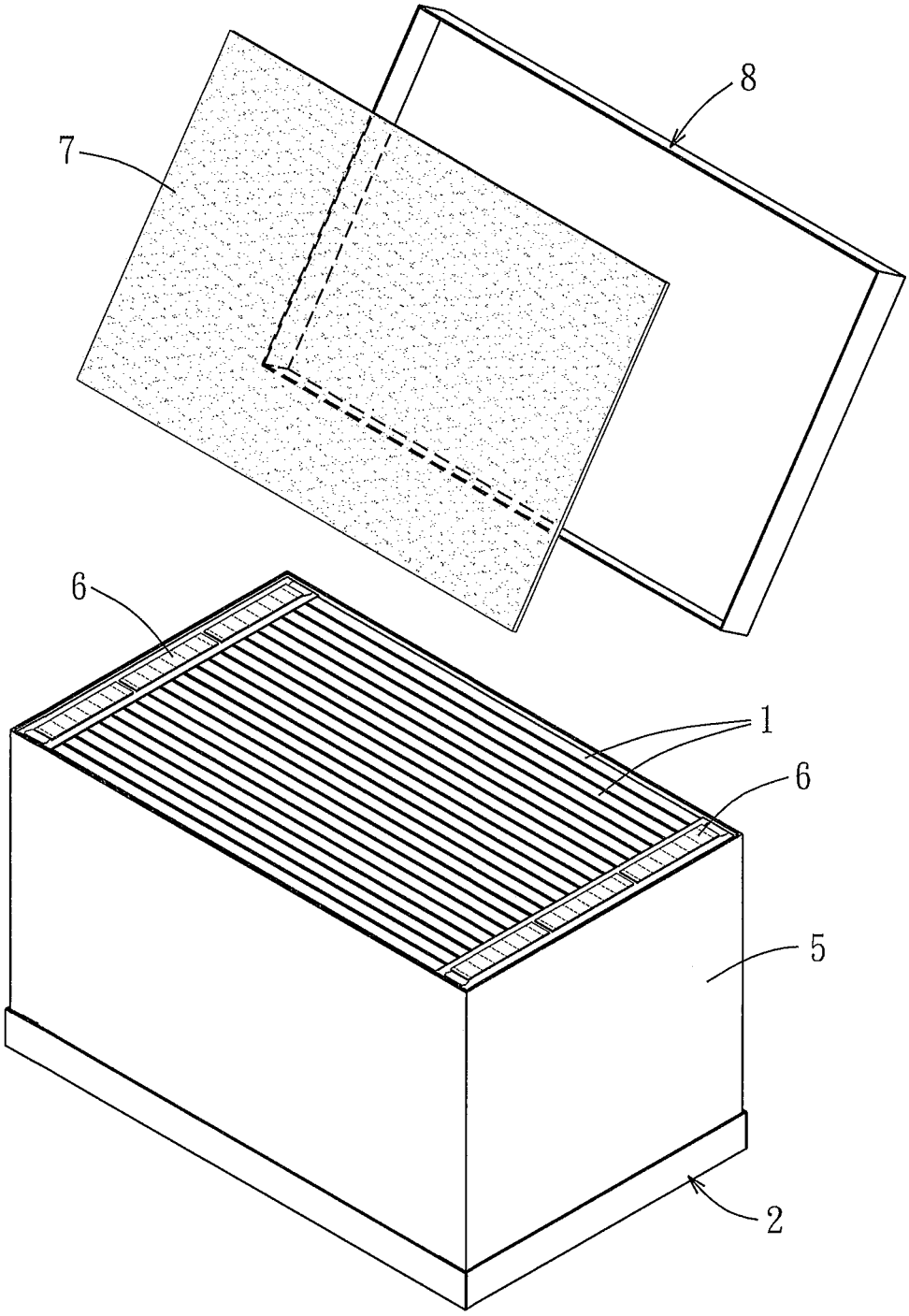
FIG. 1 is a partly exploded perspective view of the first preferred embodiment of a modular panel-packing box according to this invention.

Before the present invention is described in greater detail in connection with the preferred embodiments, it should be noted that similar elements and structures are designated by like reference numerals throughout the entire disclosure.

Referring to FIGS. 1, 2, 3, and 4, the first preferred embodiment of a modular panel-packing box according to this invention is adapted for receiving a plurality of upright panels 1, such as solar panels or LCD panels. The modular panel-packing box includes a base 2, a bottom plate 3, two first partitioning units 4, a loop-shaped surrounding wall 5, two second partitioning units 6, a top plate 7, a top cover 8, a plurality of first coupling members 428, a plurality of second coupling members 212, a plurality of third coupling members 222, and a plurality of fourth coupling members 83. In this embodiment, the base 2, the bottom plate 3, the first partitioning units 4, the loop-shaped surrounding wall 5, the second partitioning units 6, the top plate 7, and the top cover 8 are formed from paper plates, and each of the first, second, third, and fourth coupling members 428, 212, 222, 83 is a hook-and-loop fastener.

Figure 3:
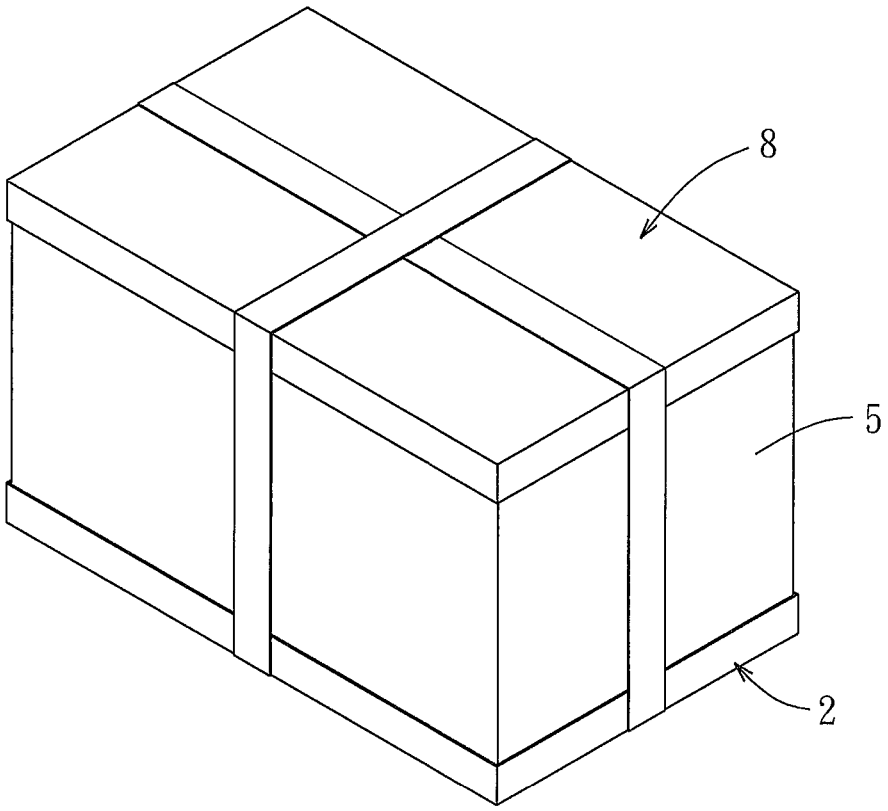
FIG. 3 is an assembled perspective view of the first preferred embodiment, illustrating that the packing box is bundled.

Positional relationships among the components of the modular panel-packing box will be described in this paragraph. The base 2 includes a rectangular bottom wall 21 provided with the second coupling members 212, and a base surrounding wall 22 provided with the third coupling members 222. The bottom plate 3 is placed on the bottom wall 21, and is disposed within the base surrounding wall 22. The first partitioning units 4 are disposed spacedly on the bottom wall 21. The panels 1 stand on the bottom plate 3, and are disposed between the first partitioning units 4. The loop-shaped surrounding wall 5 is disposed between the base surrounding wall 22 of the base 2 and the first partitioning units 4. The second partitioning units 6 cover respectively two opposite ends of a top side of each of the panels 1. The top plate 7 is disposed on and above the panels 1. The top cover 8 is disposed on and above the top plate 7. After the panels 1 are placed into the modular panel-packing box, the modular panel-packing box can be bundled, as shown in FIG. 3. At this time, each of the base 2, the first partitioning units 4, the second partitioning units 6, the top cover 8 is in a folded state.

The structures and functions of the components will now be described hereinafter.

Figure 2:
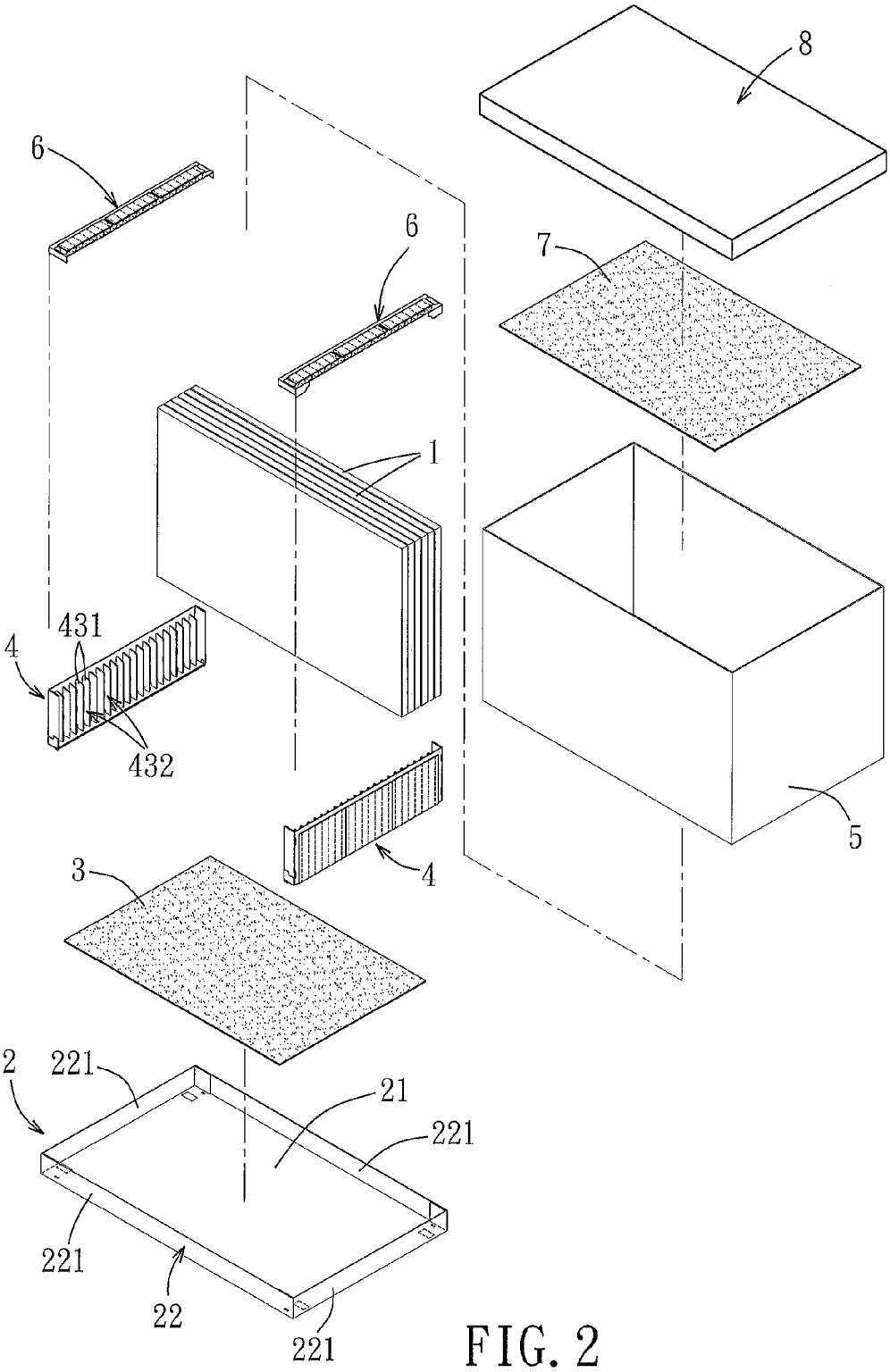
FIG. 2 is an exploded perspective view of the first preferred embodiment.
Figure 4:
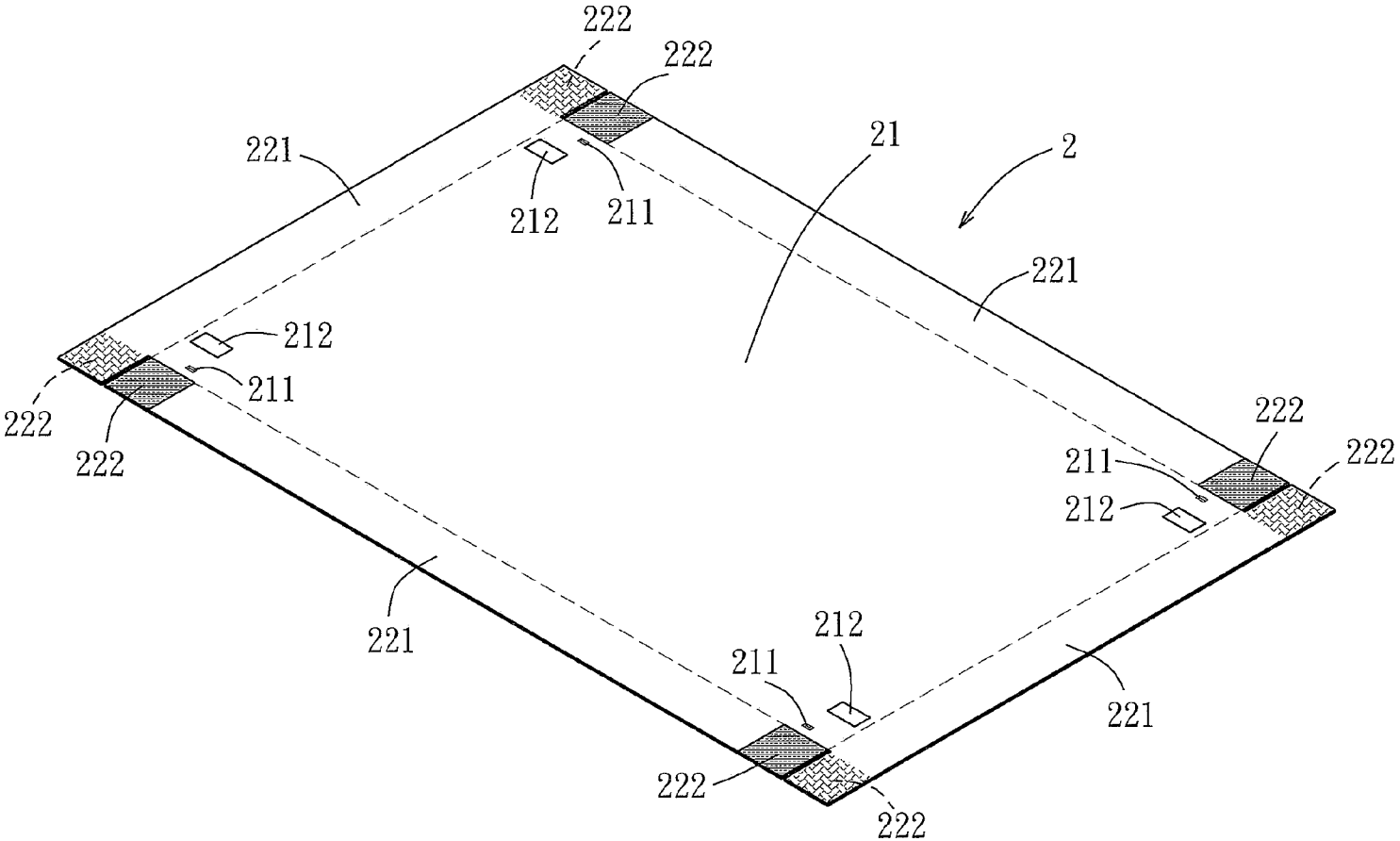
FIG. 4 is a perspective view of a base of the first preferred embodiment when it is in an unfolded state.

With particular reference to FIGS. 2 and 4, in this embodiment, the base surrounding wall 22 has four first sidewalls 221 connected respectively to four sides of the bottom wall 21. The third coupling members 222 are disposed respectively on ends of the first sidewalls 221 in adjacent pairs. Any two adjacent ones of the first sidewalls 211 are interconnected removably by one adjacent pair of the third coupling members 222, such that they are vertical. The bottom wall 21 is provided with the second coupling members 212, and four positioning holes 211 that are disposed for positioning the first partitioning units 4 on the bottom wall 21. Each of the second coupling members 212 is configured as a flat plate, and is adhered to the bottom wall 21.

Figure 5:
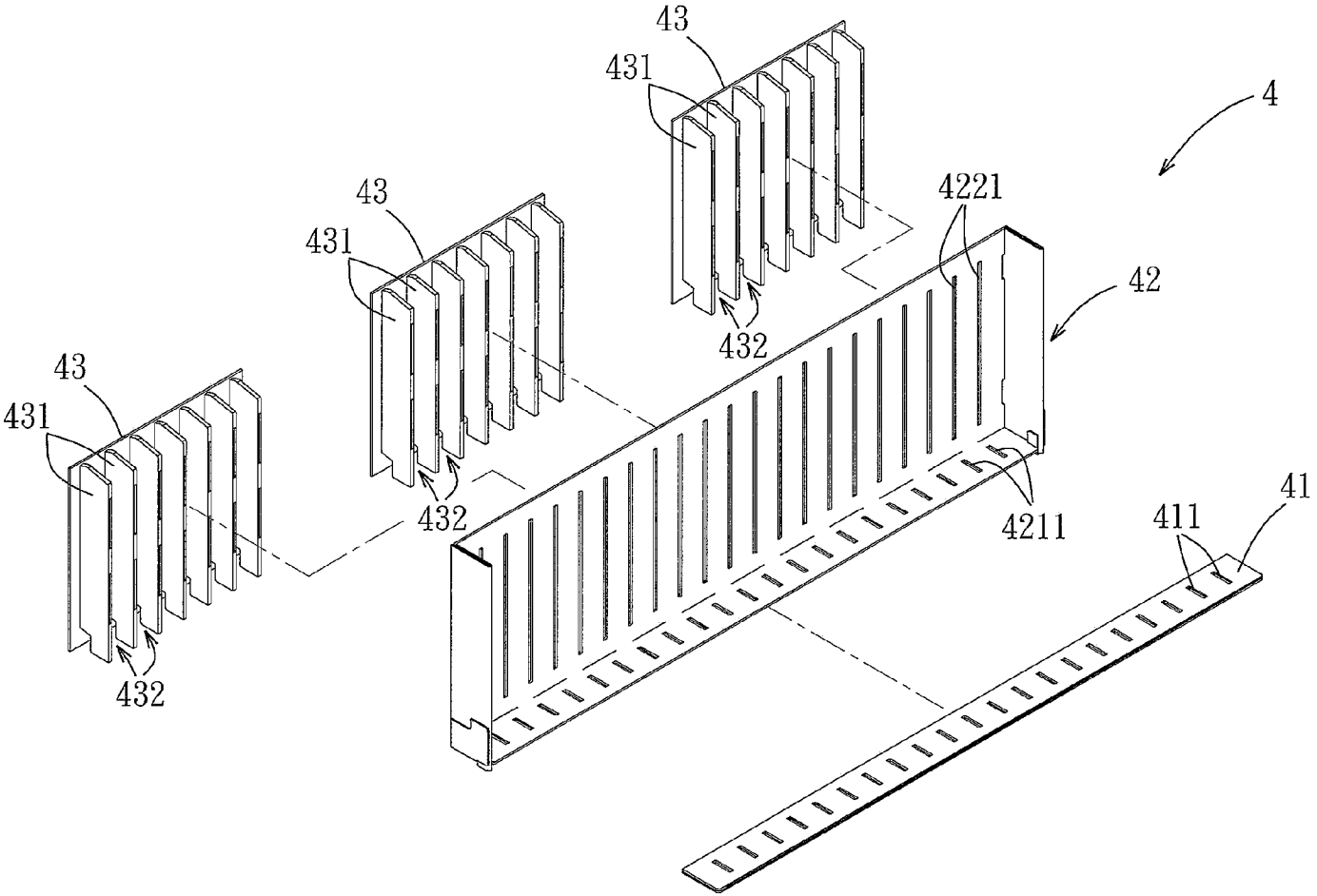
FIG. 5 is an exploded perspective view of a first partitioning unit of the first preferred embodiment.

With particular reference to FIGS. 2 and 5, each of the first partitioning units 4 includes a first bottom partitioning plate 41, a first socket 42, and three first partitioning members 43. Each of the first bottom partitioning plate 41 is formed with a plurality of first insert slots 411. Each of the first socket 42 is formed with a plurality of horizontal bottom slots 4211 and a plurality of vertical slots 4221. Each of the first partitioning members 43 has a plurality of partitioning plates 431 each inserted into the corresponding first insert slot 411 in the corresponding first bottom partitioning plate 41, the corresponding bottom slot 4211 in the first socket 42, and the corresponding vertical slot 4221 in the corresponding first socket 42. As such, each of the first partitioning members 43 are fixed on the corresponding first socket 42 and the corresponding first bottom partitioning plate 41. The first partitioning plates 431 define a plurality of first spacer slots 432. The first partitioning units 4 are disposed spacedly on the bottom wall 21. The first spacer slots 432 in one of the first partitioning units 4 are aligned respectively with those in the other of the first partitioning units 43. The panels 1 are disposed between the first partitioning units 4, and extend respectively into the first spacer slots 432 in either of the first partitioning units 4.

Figure 6:
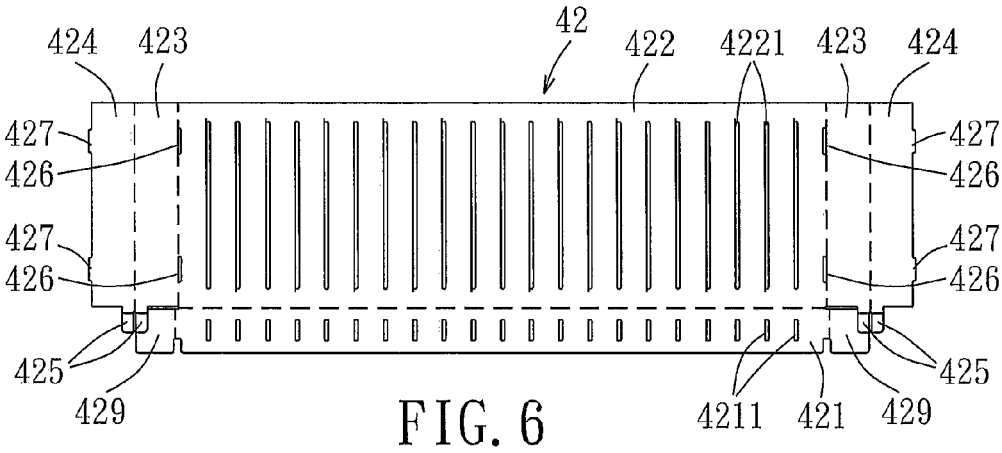
FIG. 6 is a top view of a first socket of the first partitioning unit of the first preferred embodiment when it is in an unfolded state.
Figure 7:
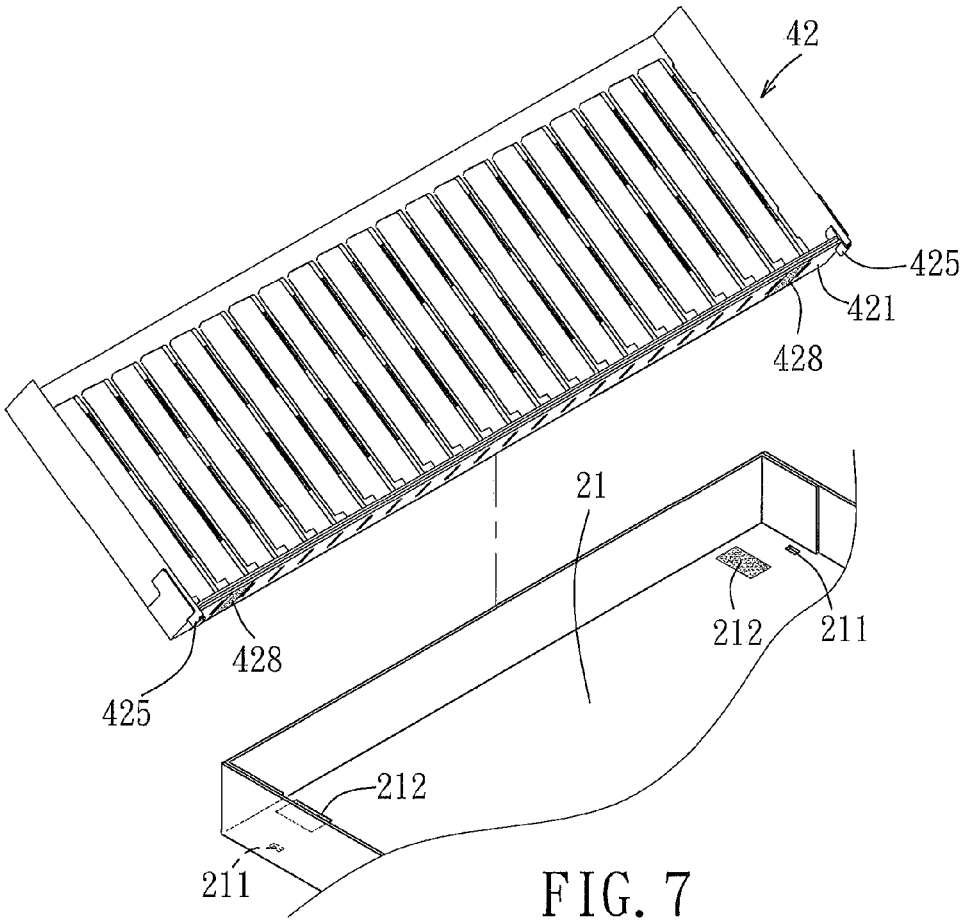
FIG. 7 is a fragmentary perspective view of the first preferred embodiment, illustrating a connection between the base and the first partitioning unit.

With particular reference to FIG. 6, each of the first sockets 42 is folded from a flat plate, and includes an elongated bottom sheet 421 abutting against the bottom wall 21 and extending along a direction perpendicular to the first insert slots 411, two wings 429 extending respectively from two opposite ends of the bottom sheet 421 away from each other, an elongated vertical sheet 422 extending upwardly from the bottom sheet 421, two first side sheets 423 extending respectively from two opposite ends of the vertical sheet 422 away from each other, two second side sheets 424 extending respectively from the first side sheets 423 away from each other, and two positioning projections 425 each extending from a junction between a respective one of the first side sheets 423 and an adjacent one of the second side sheets 424 and aligned with the bottom sheet 421. The bottom slots 4211 are formed in the bottom sheet 421. The vertical slots 4221 are formed in the vertical sheet 422. A junction between the vertical sheet 422 and each of the first side sheets 423 is formed with an insert slit 426. Each of the second side sheets 424 has an insert projection 427 that is inserted into the corresponding insert slit 426 when folded. With further reference to FIG. 7, the bottom sheet 421 of each of the first sockets 42 is provided with two of the first coupling members 428 that are connected respectively and removably to two of the second coupling members 212. The positioning projections 425 are inserted respectively into the positioning holes 211 for positioning the first partitioning units 4 on the base 2. Each of the first coupling members 428 is configured as a flat plate, and is adhered to the bottom sheet 421.

Figure 8:
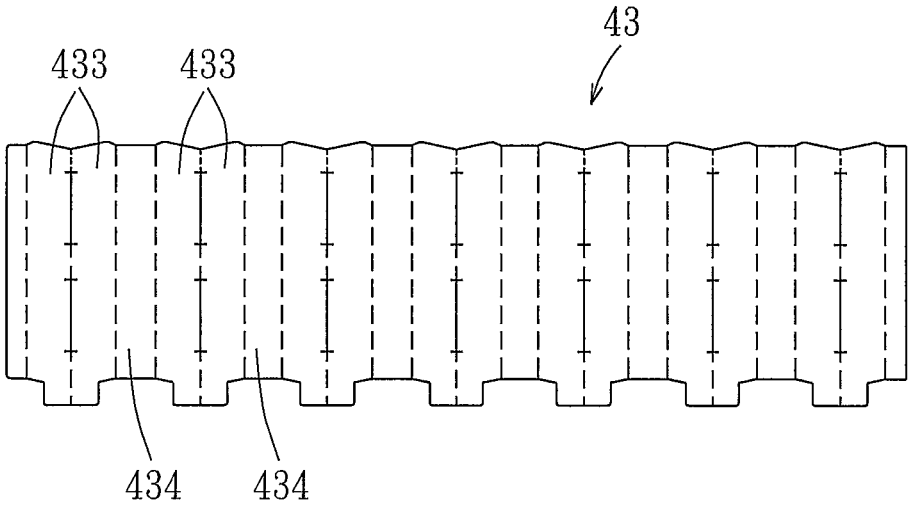
FIG. 8 is a top view of a first partitioning member of the first partitioning unit of the first preferred embodiment when it is in an unfolded state.
Figure 9:
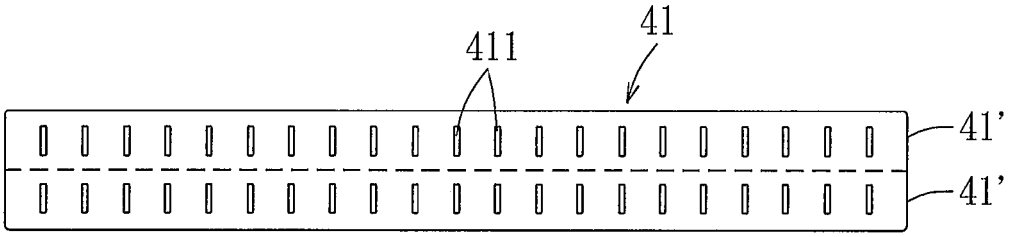
FIG. 9 is a top view of a first bottom partitioning plate of the first preferred embodiment when it is in an unfolded state.

With particular reference to FIGS. 5 and 8, each of the first partitioning members 43 is folded from a flat plate, and includes a plurality of pairs of first partitioning sheets 433, and a plurality of first spacer sheets 434 each connected between two adjacent pairs of the first partitioning sheets 433. Each pair of the first partitioning sheets 433 are interconnected and folded on each other to form one of the first partitioning plates 431. With particular reference to FIG. 9, the first bottom partitioning plate 41 is folded from two interconnected paper plates 41'.

Figure 10:
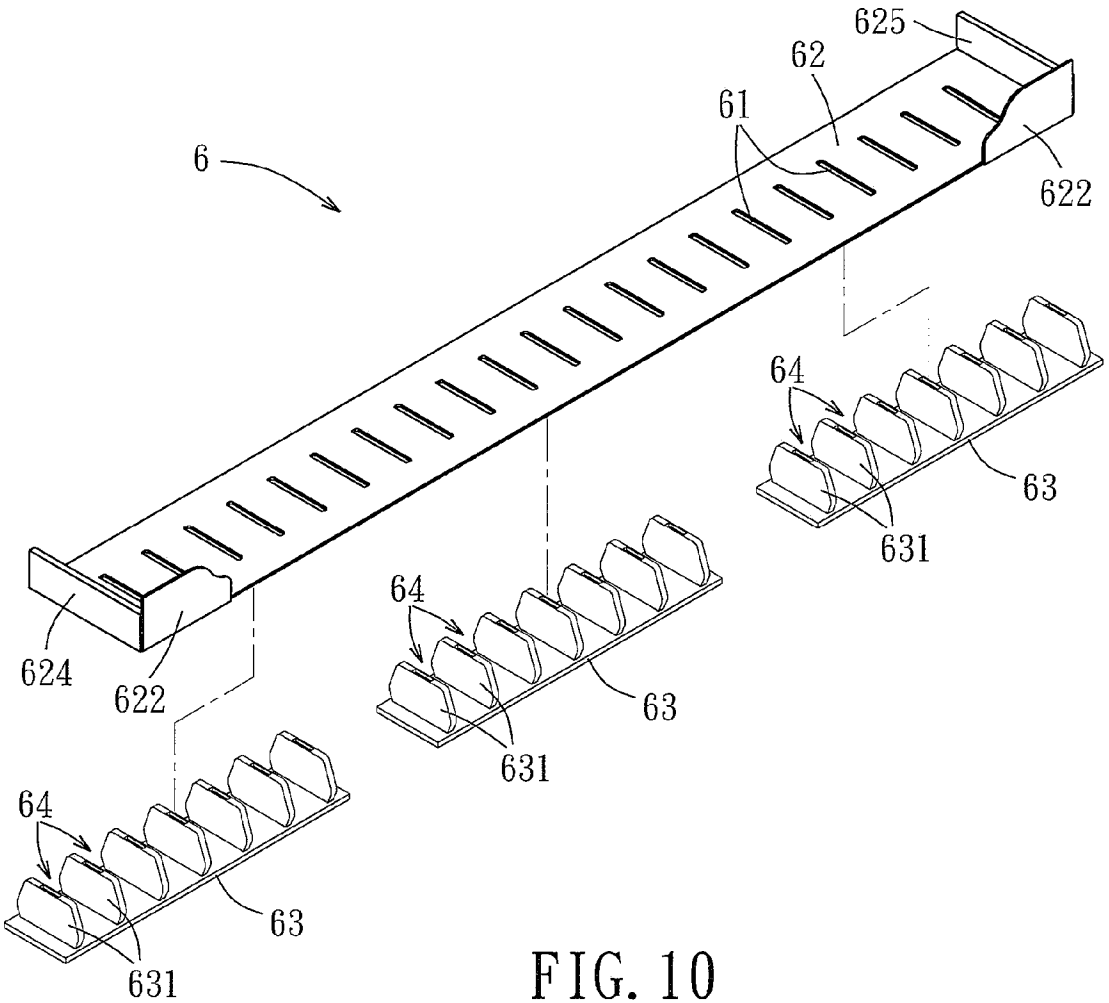
FIG. 10 is an exploded perspective view of a second partitioning unit of the first preferred embodiment.
Figure 11:
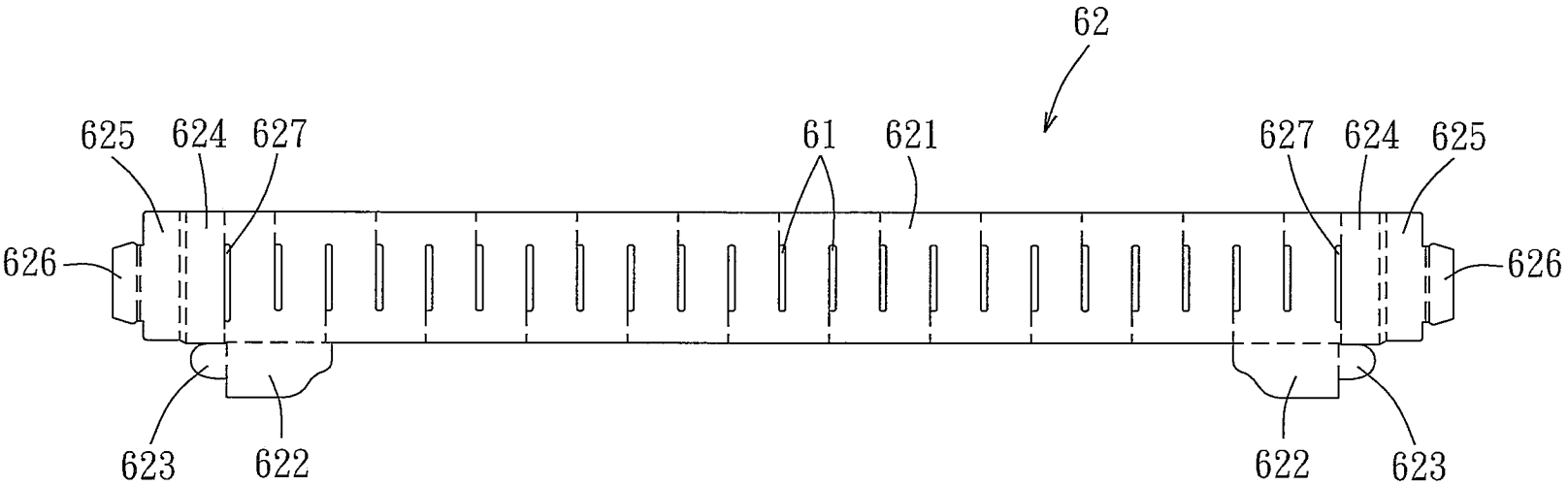
FIG. 11 is a top view of a second socket of the second partitioning unit of the first preferred embodiment when it is in an unfolded state.
Figure 12:
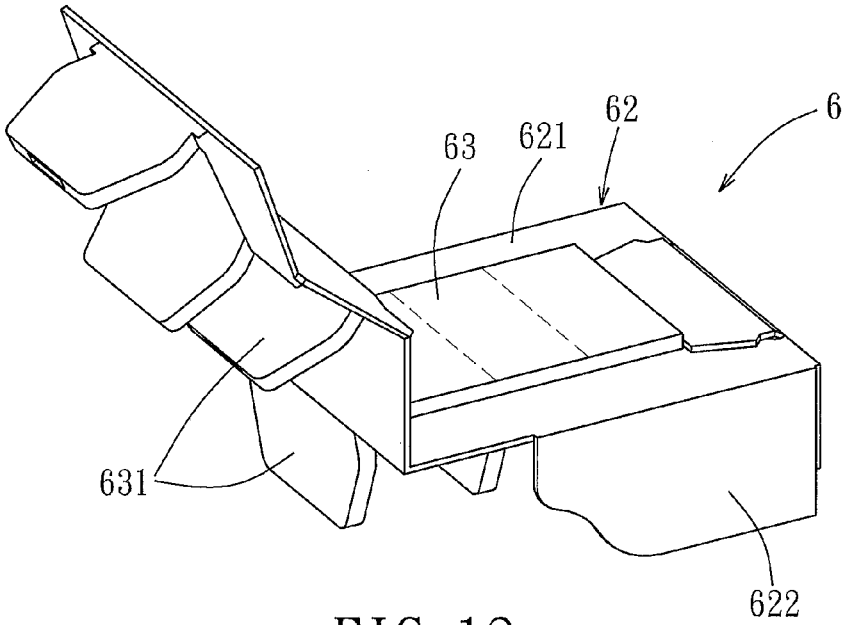
FIG. 12 is a fragmentary perspective view of the second partitioning unit of the first preferred embodiment, illustrating a manner in which a second partitioning member is assembled to the second socket.

With particular reference to FIGS. 2 and 10, each of the second partitioning units 6 includes a second socket 62 and three second partitioning members 63. The second socket 62 is formed with a plurality of second insert slots 61. Each of the second partitioning members 63 has a plurality of second partitioning plates 631. The structure of the second socket 62 is similar to that of the first socket 42. The second partitioning members 63 are similar to the first partitioning members 43 in structure. The second partitioning plates 631 in the second partitioning members 63 are inserted respectively into the second insert slots 61 in the second socket 62 to form the second partitioning units 6. The second partitioning plates 631 define a plurality of second spacer slots 64. The second partitioning units 6 are disposed spacedly on upper ends of the panels 1. The second spacer slots 64 in one of the second partitioning units 6 are aligned respectively with those in the other of the second partitioning units 6. The panels 1 are disposed between the second partitioning units 6, and extend respectively into the second spacer slots 64 in either of the second partitioning units 6. With particular reference to FIG. 11, each of the second sockets 62 is folded from a flat plate, and includes an elongated top sheet 621 covering a portion of the upper end of each of the panels 1, formed with the second insert slots 61, and extending along a direction perpendicular to the second insert slots 61, two lateral sheets 622 extending from a side of the top sheet 621, two wings 623 extending respectively from the lateral sheets 622 away from each other, two third side sheets 624 extending respectively from two opposite ends of the top sheet 621 away from each other, two fourth side sheets 625 extending respectively from the third side sheets 624 away from each other, and two coupling sheets 626 extending respectively from the fourth side sheets 624 away from each other. A junction between the top sheet 621 and each of the third side sheets 624 is formed with a coupling slot 627 engaging the corresponding coupling sheet 626. It should be noted that, with particular reference to FIG. 12, during assembly of one of the second partitioning units 6, the second partitioning plates 631 can be folded one by one, and as soon as one of the second partitioning plates 631 is formed, it can be inserted into the second socket 62.

Figure 13:
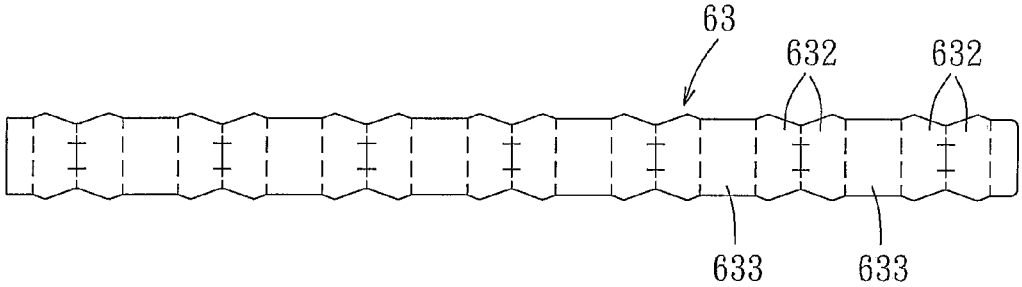
FIG. 13 is a top view of the second partitioning member of the second partitioning unit of the first preferred embodiment when it is in an unfolded state.

With particular reference to FIGS. 10 and 13, each of the second partitioning members 63 includes: a plurality of pairs of second partitioning sheets 632, each pair of the second partitioning sheets 632 being interconnected and folded on each other to form one of the second partitioning plates 631; and a plurality of second spacer sheets 633 each connected between two adjacent pairs of the second partitioning sheets 632.

With particular reference to FIG. 1, the top plate 7 is formed from a flat plate, and is used for protecting the upper ends of the panels 1 and providing a cushioning effect when the module panel-packing box is subjected to a downward pressure.

Figure 14:
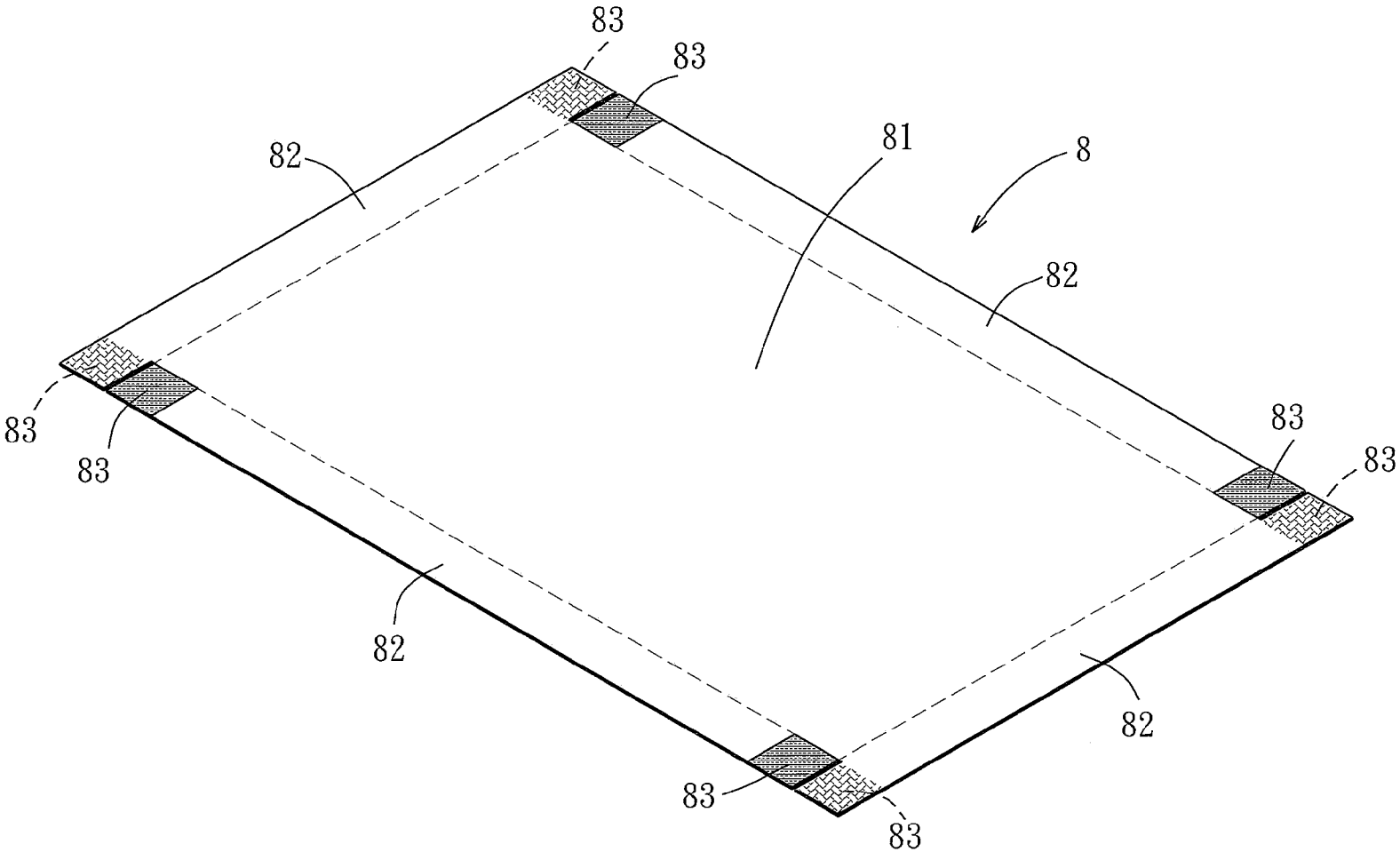
FIG. 14 is a top view of a top cover of the first preferred embodiment when it is in an unfolded state.

With particular reference to FIGS. 2 and 14, the top cover 8 is connected to the loop-shaped surrounding wall 5 for covering the upper ends of the panels 1. The top cover 8 includes a rectangular top wall 81 and four second sidewalls 82 connected respectively to four sides of the top wall 81. Each of the second sidewalls 82 has two opposite ends each provided with one of the fourth coupling members 83. Any two adjacent ones of the ends of the second sidewalls 82 are interconnected removably by two corresponding ones of the fourth coupling members 83.

Figure 15:
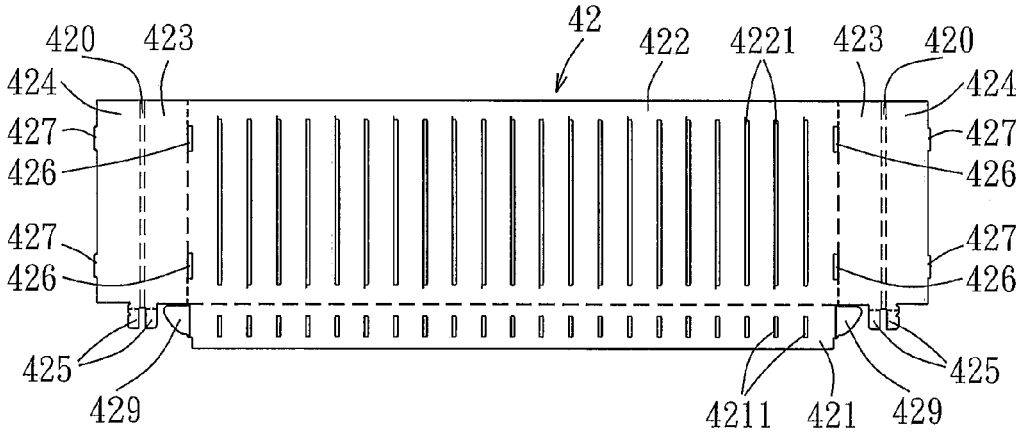
FIG. 15 is a top view of a first socket of the second preferred embodiment of a modular panel-packing box according to this invention.
Figure 16:
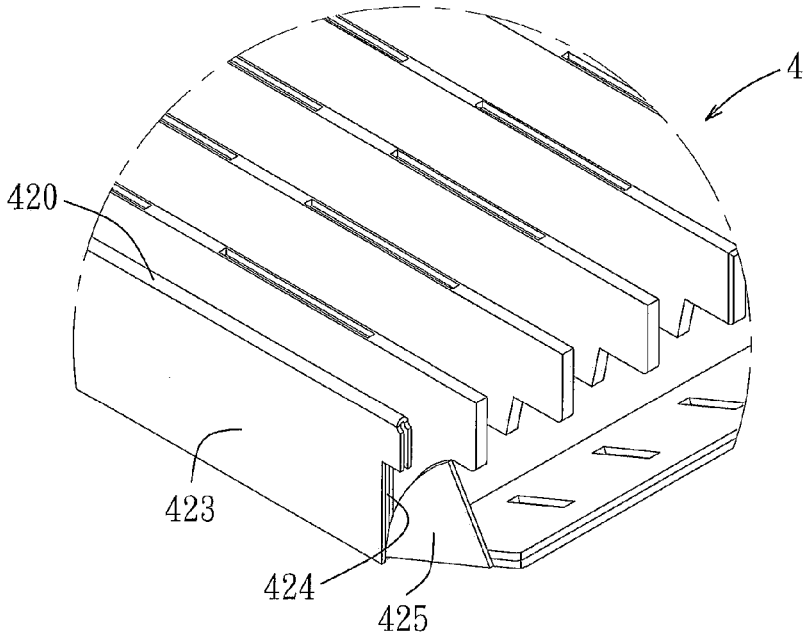
FIG. 16 is a fragmentary perspective view of the first socket of the second preferred embodiment, illustrating how the first socket is assembled.
Figure 17:
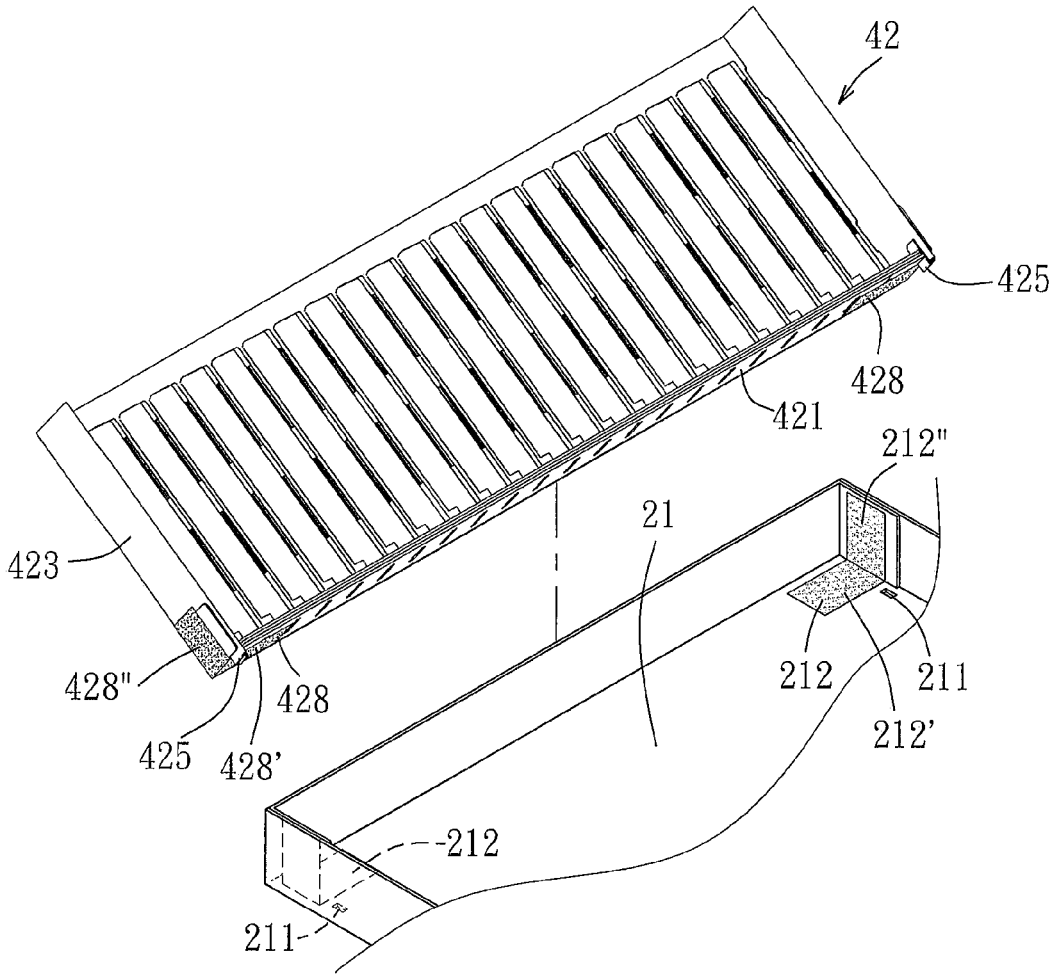
FIG. 17 is a fragmentary exploded perspective view of a base and a first partitioning unit of the third preferred embodiment of a modular panel-packing box according to this invention.

FIGS. 15 and 16 show a modified first socket 42, which further includes two spacer portions 420 each connected between the corresponding first side sheet 423 and the corresponding second side sheet 424 so that, when the first socket 42 is in a folded state, a space is formed between the first side sheet 423 and the second side sheet 424, and allows for insertion of the corresponding wing 429. Unlike the first preferred embodiment, each of the wings 429 has a shape of one quarter of a circle. FIG. 17 shows modified first and second coupling members 428, 212. The modified first coupling member 428 is L-shaped, and has a horizontal plate portion 428' adhered to the corresponding bottom sheet 421, and a vertical plate portion 428" adhered to the corresponding first side sheet 423. The modified second coupling member 212 has a horizontal plate portion 212' adhered to the bottom wall 21, and a vertical plate portion 212" perpendicular to the bottom wall 21. Addition of the vertical plate portion 212" can increase the contact area between the first and second coupling members 428, 212 and, thus, the strength of an assembly of the base 2 and the first partitioning unit 4.

Figure 18:
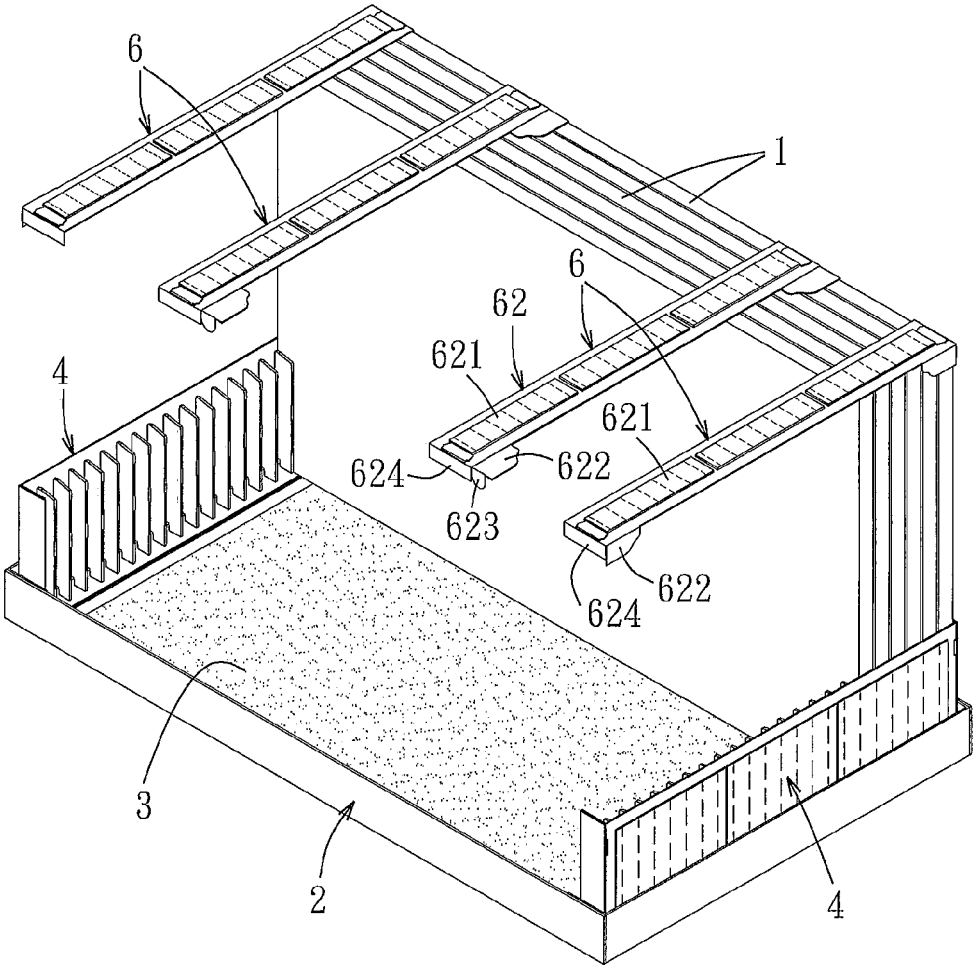
FIG. 18 is a fragmentary perspective view of the fourth preferred embodiment of a modular panel-packing box according to this invention, illustrating a modified second partitioning unit.

To meet actual needs, the number of the second partitioning units 6 may be increased. For example, with particular reference to FIG. 18, four second partitioning units 6 are included in the modular panel-packing box. Two outer second partitioning units 6 are similar to those of the first preferred embodiment in structure. In the inner second partitioning units 6, the lateral sheets 622 are not folded, and each of the wings 623 is not inserted between the corresponding third and fourth side sheets 624, 625. An increase in the number of the second partitioning units 6 results in a decrease in the vibration of the panels 1 and the friction among the panels 1.

With this invention thus explained, it is apparent that numerous modifications and variations can be made without departing from the scope and spirit of this invention. It is therefore intended that this invention be limited only as indicated by the appended claims.

I claim:

1. A modular panel-packing box adapted for receiving a plurality of upright panels, said modular panel-packing box comprising:

a base including a bottom wall and a base surrounding wall extending upwardly from a periphery of said bottom wall;

two first partitioning units disposed removably on said bottom wall and spaced apart from each other, each of said first partitioning units including a first socket formed with a plurality of first insert slots, and at least one first partitioning member having a plurality of first partitioning plates each inserted into a corresponding one of said first insert slots in said first socket, said first partitioning plates defining a plurality of first spacer slots, said first spacer slots in one of said first partitioning units being aligned respectively with said first spacer slots in the other of said first partitioning units, so that the panels are disposed between said first partitioning members of said first partitioning units, and extend respectively into said first spacer slots in either of said first partitioning units;

a loop-shaped surrounding wall disposed removably on said base and surrounding said first partitioning units; and a top cover connected removably to said loop-shaped surrounding wall and adapted for covering upper ends of the panels;

wherein, said base is unfoldable to form a flat plate; and wherein, each of said first sockets and first partitioning members of said first partitioning units and said top cover is unfoldable to form a flat plate when removed from said base.

2. The modular panel-packing box as claimed in claim 1, wherein each of said first sockets includes an elongated bottom sheet abutting against said bottom wall and extending along a direction perpendicular to said first insert slots, an elongated vertical sheet extending upwardly from said bottom sheet and formed with said first insert slots, two first side sheets extending respectively from two opposite ends of said bottom sheet away from each other, and two second side sheets extending respectively from said first side sheets away from each other, a junction between said vertical sheet and each of said first side sheets being formed with an insert slit, each of said second side sheets having an insert projection inserted into said insert slit formed between said vertical sheet and an adjacent one of said first side sheets.

3. The modular panel-packing box as claimed in claim 2, wherein each of said first partitioning members of said first partitioning units includes a plurality of pairs of first partitioning sheets, and a plurality of first spacer sheets each connected between two adjacent pairs of said first partitioning sheets, each pair of said first partitioning sheets being interconnected to form one of said first partitioning plates.

4. The modular panel-packing box as claimed in claim 3, wherein each of said first sockets is provided with at least one first coupling member, said bottom wall being rectangular and being provided with at least two second coupling members connected respectively and removably to said first coupling members of said first sockets, said base surrounding wall including four first sidewalls connected respectively to four sides of said bottom wall, each of said first sidewalls having two opposite ends each provided with a third coupling member, any two adjacent ones of said ends of said first sidewalls being interconnected removably by two corresponding ones of said third coupling members, said top cover including a rectangular top wall and four second sidewalls connected respectively to four sides of said top wall, each of said second sidewalls having two opposite ends each provided with a fourth coupling member, any two adjacent ones of said ends of said second sidewalls being interconnected removably by two corresponding ones of said fourth coupling members.

5. The modular panel-packing box as claimed in claim 4, wherein each of said first and second coupling members is L-shaped, each of said first coupling members being adhered to said bottom sheet and a corresponding one of said first side sheets, each of said second coupling members being adhered partially to said bottom wall and having a portion perpendicular to said bottom wall.

6. The modular panel-packing box as claimed in claim 5, wherein said first, second, third, and fourth coupling members are hook-and-loop fasteners.

7. The modular panel-packing box as claimed in claim 6, further comprising two second partitioning units, each of said second partitioning units including a second socket formed with a plurality of second insert slots, and at least one second partitioning member having a plurality of second partitioning plates each inserted into a corresponding one of said second insert slots in said second socket, said second partitioning plates defining a plurality of second spacer slots, said second spacer slots in one of said second partitioning units being aligned respectively with said second spacer slots in the other of said second partitioning units, so that the panels are disposed between said second partitioning units, and extend respectively into said second spacer slots in either of said second partitioning units.

8. The modular panel-packing box as claimed in claim 7, wherein each of said second partitioning members of said second partitioning units includes a plurality of pairs of second partitioning sheets, and a plurality of second spacer sheets each connected between two adjacent pairs of said second partitioning sheets, each pairs of said second partitioning sheets being interconnected and folded on each other to form one of said second partitioning plates.

9. The modular panel-packing box as claimed in claim 7, wherein each of said second sockets includes an elongated top sheet adapted for covering a portion of the upper end of each of the panels, formed with said second insert slots, and extending along a direction perpendicular to said second insert slots, two lateral sheets extending from a side of said top sheet, two wings extending respectively from said lateral sheets away from each other, two third side sheets extending respectively from two opposite sides of said top sheet away from each other, two fourth side sheets extending respectively from said third side sheets away from each other, two coupling sheets extending respectively from said fourth side sheets away from each other, and two coupling slots each formed between said top sheet and a respective one of said third side sheets and permitting a respective one of said coupling sheets to be inserted thereinto.

* * * * *